United States Patent [19]

Nozdrovsky

[11] 4,009,823

[45] Mar. 1, 1977

[54] BOWL OF SOLIDS-CONCENTRATION CENTRIFUGE

[76] Inventor: Andrei Stepanovich Nozdrovsky, Krasnaya ulitsa, 50, kv. 29, Leningrad, U.S.S.R.

[22] Filed: Nov. 12, 1975

[21] Appl. No.: 631,031

[30] Foreign Application Priority Data

June 25, 1974 U.S.S.R. ..... 2032423

[52] U.S. Cl. ..... 233/7; 233/29

[51] Int. Cl.[2] ..... B04B 3/04

[58] Field of Search ..... 233/7, 27, 28, 29

[56] References Cited

UNITED STATES PATENTS

| | | | |
|---|---|---|---|
| 2,622,794 | 12/1952 | Smith | 233/7 |
| 3,348,767 | 10/1967 | Ferney | 233/7 |

FOREIGN PATENTS OR APPLICATIONS

| | | | |
|---|---|---|---|
| 1,082,817 | 6/1954 | France | 233/7 |
| 1,449,064 | 7/1966 | France | 233/7 |
| 708,590 | 5/1954 | United Kingdom | 233/7 |

*Primary Examiner*—George H. Krizmanich
*Attorney, Agent, or Firm*—Steinberg & Blake

[57] ABSTRACT

The bowl of centrifuge is essentially a hollow case with openings for the outflow of the liquid clarified at one end and with openings for discharging the cake at the opposite end. Disposed in the case coaxially with same is a scroll with a quill, the slurry to be centrifuged being fed into the bore of said quill at one of the end faces. Disposed in the bore of the scroll quill close to the openings for the outflow of the liquid clarified is a stack of separating discs each given the shape of a truncated cone and separated one from another by spacers so that clearances are provided therebetween. The discs are pierced with holes, placing all the clearances in communication one with another and with the bore of the scroll quill so that the slurry centrifuged can enter the clearances. Fitted in the bore of the scroll quill within the portion occupied by the stack of the separating discs are radial projections which interact with the outer edges of the discs so as to keep same coaxially with the scroll quill. The wall of the scroll quill is pierced all the way down its length with holes which place the bore of the scroll quill in communication with the space inside the case so that the cake can be discharged thereinto, said holes being provided within the portion of the quill occupied by the stack of the separating discs between all the radial projections.

4 Claims, 4 Drawing Figures

BOWL OF SOLIDS-CONCENTRATION CENTRIFUGE

The present invention relates to apparatus for the separation of slurries achieved by precipitating the particles of solid phase contained therein under the action of centrifugal forces, and more specifically to bowls of continuous solids-concentration centrifuges finding a wide-spread application in hydrometallurgy, the chemical industry and elsewhere to cope with the task of separating slurries.

The present invention may be used to advantage for the separation of finely dispersed slurries which render themselves to the process reluctantly and which cannot be filtered by means of the known filters because the process is impossible in itself or gives little effect and must be rejected for the sake of economy.

With no less success, the present invention may be used for the separation of slurries which, although displaying high filtrating ability, require an increase in the consistency before being separated. In this case, both operations can be performed in one go.

There are known in the art bowls of continuous solids-concentration centrifuges incorporating a hollow case with openings for the outflow of the liquid clarified at one end and with openings for discharging the cake at the opposite end. Disposed in the case coaxially with same is a scroll which serves to discharge the cake and which is provided with a quill whose bore communicates at one of the end faces with a device for feeding the slurry to be centrifuged. Disposed in the bore of the scroll quill coaxially with same and close to the openings for the outflow of the liquid clarified is a stack of separating discs each given the shape of a truncated cone and separated one from aother by spacers so that clearances are provided therebetween. The discs are pierced with holes, placing all the clearances in communication one with another and with the bore of the scroll quill so that the slurry centrifuged can enter the clearances when the bowl is set spinning. The separating discs sub-divide the bore of the scroll quill into narrow tapered spaces which enable the most finest particles of the solid phase contained in the slurry to settle down on the inside surfaces of the discs when the bowl is spinning. The wall of the scroll quill is pierced all the way down its length with holes which place the bore of the scroll quill in communication with the space inside the case so that the cake can be discharged thereinto. On contacting the surface of the scroll, the cake is conveyed by the rotating scroll towards the discharge openings.

In such known bowls, the stack of the separating discs is disposed inside the bore of the scroll quill on a discholder. The separating discs being aligned by means of the inner edges, i.e., using the inner diameter are mounted on the cylindrical portion of the discholder running coaxially with the scroll. In such known bowls, the slurry centrifuged reaches the clearances between the separating discs either through the clearances provided between the outer edges and the inner wall of the scroll quill or, as pointed out above, through the holes the discs are pierced with.

The main disadvantage of the bowls of solids-concentration centrifuge described above is that the clearances between the separating discs cannot be washed without taking the centrifuge apart, for the case carrying the stack of the separating discs is arranged at the inner edges of said discs. Said disadvantage of the known bowl calls for shutting down the centrifuge after a short period in operation, taking it apart and washing the stack of separating discs from the cake which gradually blinds the clearances, impairing the throughput of the centrifuge and inviting difficulties in operating same.

Another disadvantage of the known bowls of solids-concentration centrifuges is that the slurry centrifuged which flows through the clearances of the separating discs meets the cake leaving same clearances. The result is that some of the cake is carried by the slurry back into the clearances between the discs. This not only seriously interferes with the process of separation but also reduces the throughput of the centrifuge below the theoretical one.

Furthermore, the known bowls of centrifuges fail to distribute the slurry centrifuged between all the clearances in a uniform way. In fact, the slurry enters the clearances between the discs either through the perimeter of the stack or through the perimeter of each of the holes the discs are pierced with, where such holes are provided for. Under the conditions like these, it is impossible to provide at all points where the slurry enters the clearances between the discs a head which is sufficiently high to assure a uniform distribution of the slurry. This, in its turn, impairs the process of separation.

One object of the present invention is to provide a bowl for solids-concentration centrifuge with the stack of the separating discs so designed that the clearances between said discs can be washed without taking the centrifuge apart. This will cut the labour requirements for servicing the centrifuge, improve the process of separation and add to the throughput of the centrifuge as a whole.

This and other objects are attained in a bowl of solid-concentration centrifuge disposed in a hollow case thereof, with openings for the outflow of the liquid clarified at one end and with openings for discharging the cake at the opposite end, there is a coaxial scroll with a quill in the bore of which, communicating with a device for feeding the slurry centrifuged at one of the end faces, is provided coaxially with said quill a stack of separating discs each given the shape of a truncated cone, separated one from another by spacers to that clearances are formed therebetween and pierced with holes which place all the clearances in communication one with another so that the slurry centrifuged can enter said clearances from the bore of the scroll quill when the bowl is set spinning, and the wall of the scroll quill is pierced with holes all the way down its length which place the bore of the scroll quill in communication with the space inside the case so as to enable the cake to be discharged thereinto. In accordance with the invention, provided on the inner surface of the scroll quill within the portion occupied by the stack of the separating discs are radial projections, interacting with the outer edges of the separating discs so as to set them coaxially with the scroll quill, and the holes piercing its wall are provided within said portion between the adjacent radial projections.

Said arrangement allows to align the stack of the separating discs at the outer diameter of the discs, giving consequently access to the clearances between the discs from the inner side of the stack, enabling the washing of the stack without taking the centrifuge apart, improving the process of separation and increasing the throughput of the centrifuge.

It is preferred that the radial projections are disposed pairwise and, in fact, equidistantly all the way around the circumference of the inner surface of the scroll quill, and the holes piercing the separating discs are provided at the outer edges thereof in the form of coaxial trapezoidal recesses each located in front of a portion of the inner surface of the scroll quill between each said pair of radial projections, the spacers between the separating discs being fitted at said recesses and being provided with recesses registering with the recesses in the discs, and the outer edge of each spacer on both sides of the recess ending short of the outer edge of the separating discs so that slots are formed therebetween each bound by the outer edge of the spacer and the corresponding radial projections; said slots serve to admit the slurry centrifuged into the clearances between the adjacent separating discs.

Owing to said arrangement, the recess in each of the coaxially disposed rows of the spacers in conjunction with the corresponding recesses in the discs and also with the portions of the wall of the scroll quill located in front of said recess and further with the pairs of the radial projections bounding said portions form the walls of a longitudinal passage flowing wherethrough is the slurry, said passage communicating with each of the clearances between the discs through two said slots disposed on either side of the recess in each spacer between its outer edge and said radial projections.

Said arrangement assures that the slurry fed into the clearances between the separating discs does not meet the outflow of the cake from the same clearances, said longitudinal passages being separated from the clearances between the discs and communicating with said clearances only through said slots. As a result, the cake forming on the inner surface of the discs when the rotor is spinning flows down the surface of separating discs between the spacers due to the action of centrifugal forces. By selecting the right cross-sectional area of the longitudinal passages and the width of the slots, it is possible to make for a uniform distribution of the slurry between the clearances.

This all allows to improve substantially the process of separation and increase the throughput of the centrifuge, particularly in handling finely dispersed slurries.

It is also preferred that each of the radial projections is, in fact, a trapezoid in cross section with the shorter base facing the separating discs and of a height which exceeds half the maximum distance between the nearest edges of the adjacent holes in the wall of the scroll quill. This assures a free outflow of the cake from the clearances between the discs and prevents the blocking the exits from the clearances by the cake deposited on the inner surface of the scroll case between said holes.

What follows is a detailed description of a preferred embodiment of the present invention with reference to the accompanying drawings in which.

Figure 1:
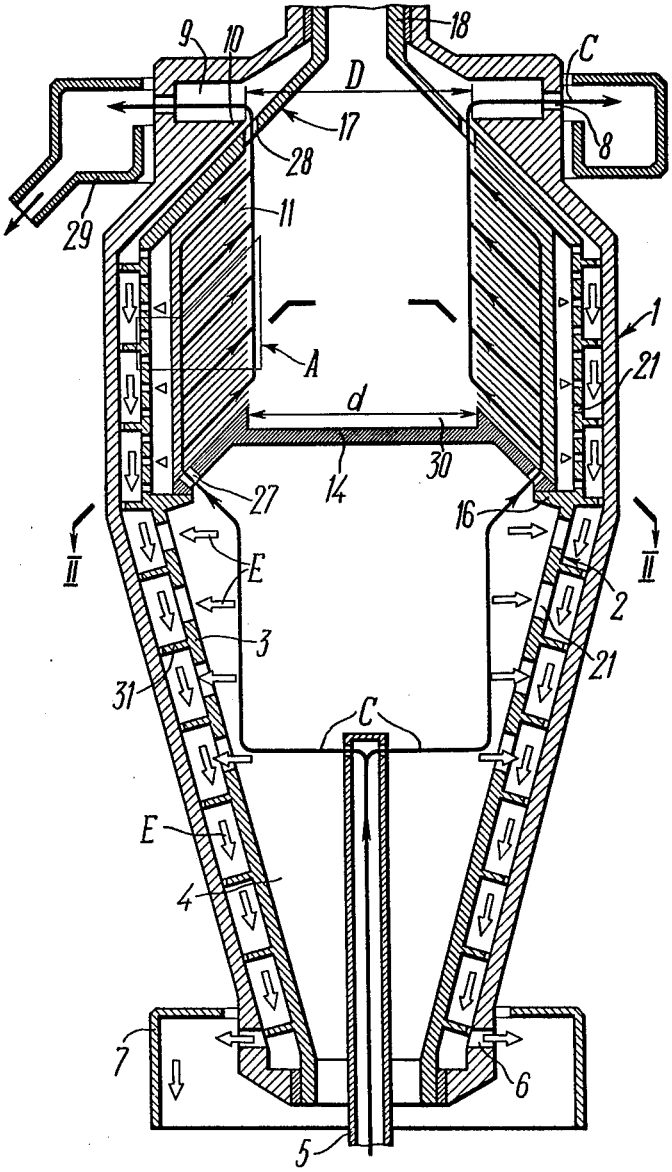
FIG. 1 is a schematic sectional elevation of the bowl for vertical solids-concentration centrifuge according to the invention.

Referring to FIG. 1, the bowl of vertical solids-concentration centrifuge consists of a hollow case 1 which is a cylinder at the upper end and a truncated cone narrowing towards the bottom at the lower end, the cone being arranged coaxially and contiguously with the cylinder. Installed in the case 1 coaxially therewith is a scroll 2 having an outer screw and an inner shell or quill 3 which is made up also of a cylindrical portion and a conical one disposed in the corresponding ends of the case 1 equidistantly from the inner surface of its walls. The hollow interior or bore 4 of the quill 3 of the scroll 2 communicates through a feed pipe 5 immovably placed along its axis at the lower or discharge end with a device (not shown) for feeding the slurry centrifuged into said bore.

Provided in the lower end of the case 1 at the discharge end of the scroll 2 are radial openings 6 wherethrough the separated cake conveyed by the scroll 2 is discharged into a dry housing 7 which surrounds the case 1 and is immovably fitted to the centrifuge base.

Provided in the upper end of the case 1 are radial openings 8 wherethrough the liquid clarified is discharged from a collecting chamber 9 of the case 1, said chamber being separated from the working chamber of said case by means of an annular threshold 10 running all the way along the circumference.

Figure 2:
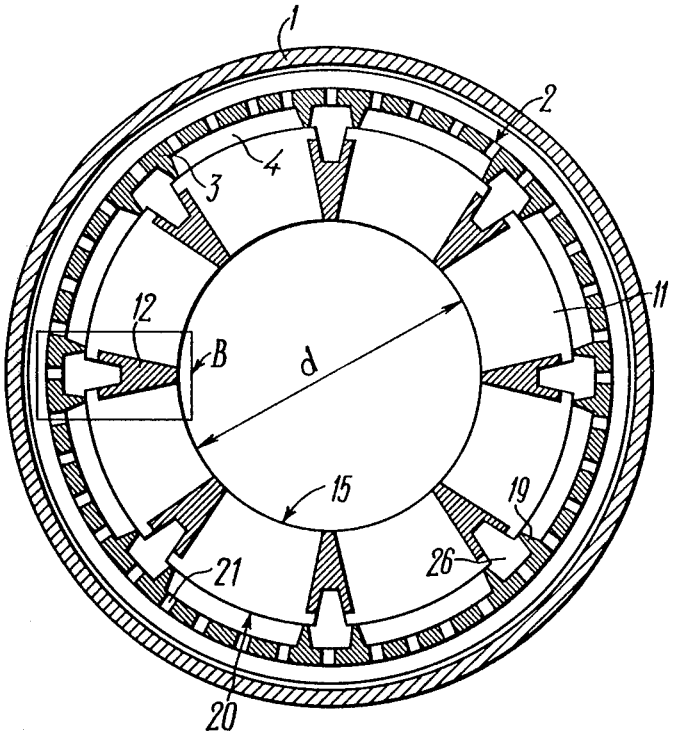
FIG. 2 is a section on line II—II of FIG. 1.

Disposed in the bore 4 of the quill 3 of the scroll 2 close to the openings 8 and coaxially with the quill 3 is a stack of separating discs 11 each given the shape of a truncated cone and separated one from another by spacers 12 (FIGS. 2 and 4) so that clearances 13 (FIG. 3) are formed therebetween.

The stack of the separating discs 11 rests on a bottom plate 14 also given the shape of a truncated cone, its inner diameter being equal to the diameter, d, of inner edges 15 of the separating discs 11. The bottom plate 14 of the stack of the separating discs 11, in its turn, rests all the way along its circumference on an annular projection 16 provided on the inner surface of the quill 3 of the scroll 2. Topping the stack of the separating discs 11 is a conical cover plate 17 which separates the bore 4 of the quill 3 of the scroll 2 from the collecting chamber 9 of the bowl case 1 and forms an end piece 18 of the quill 3 of the scroll 2 at the top.

The separating discs 11 subdivide the bore 4 of the quill 3 of the scroll 2 within the limits of the space occupied therewith into narrow tapered spaces, facilitating thus the settling of the fine particles of the solid phase of the slurry on the inner surfaces of said discs.

In accordance with the invention, provided on the inner surface of the quill 3 of the scroll 2 within the length occupied by the stack of the separating discs 11 are radial projections 19 (FIGS. 2 and 4), interacting with outer edges 20 (FIG. 4) of the separating discs 11 so as to set them coaxially with the quill 3 of the scroll 2. In other words, said projections align the stack of the separating discs at the outer edges of same.

Said arrangement gives access to the clearances 13 between the discs 11 from their inner edges, enabling the washing of the clearances 13 at regular intervals without taking the centrifuge apart. This simplifies the running of the centrifuge and improves its operational reliability. By washing the clearances 13 between the separating discs 11 at regular intervals, the process of separating the slurry centrifuged is improved, particularly when handling finely-dispersed slurries or those which separate reluctantly.

To prevent bending of the inner edges 15 of the separating discs 11 and influencing the uniform distribution of the slurry between them, the inner diameter, *d*, of said edges is somewhat smaller than the diameter, D, of the annular threshold 10 of the bowl case I.

The wall of the quill 3 of the scroll 2 is pierced all the way down its length with holes 21 (FIGS. 1, 2 and 3) which place the bore 4 of the quill in communication with the space inside the bowl case 1 for discharging the cake thereinto, said holes 21 within the portion occupied by the stack of the separating discs being provided between the adjacent radial projections 19.

In accordance with the invention, the radial projections 19 are disposed pairwise and, in fact, equidistantly all the way around the circumference of the inner surface of the quill 3 of the scroll 2, and each of the projections 19 is a trapezoid in cross section with the shorter base facing the separating discs 11 and of a height 19*a* which exceeds half the maximum distance between the nearest edges of the adjacent holes 21 piercing the wall of the quill 3 of the scroll 2.

The separating discs 11 are pierced with holes 22 (FIG. 4) provided in their outer edges 20 in the form of coaxial trapezoidal recesses each of which is disposed, according to the invention, in front of the portion of the inner surface of the quill 3 of the scroll 2 between each of said pairs of the radial projections 19.

According to the invention, the spacers 12 interposed between the separating discs 11 are fitted at the holes 22 piercing same in the form of recesses. Each of the spacers 12 is given the shape of a sector in plan and is provided at the outer edge 23 also with a trapezoidal recess 24 registering with the corresponding recesses 22 in the separating discs 11, the outer edge 23 of each spacer 12 ending on either side of the recess 24 short of the outer edges 20 of the separating discs 11 so that two side slots 25 are formed therebetween bound by the outer edge 23 of the spacer 12 and the radial projections 19.

As it will be noted, the recesses 24 in each of the coaxially disposed rows of the spacers 12 in conjunction with the corresponding recesses 22 in the discs 11 and also with the portions of the wall of the quill 3 of the scroll 2 located in front of said recesses and further with the pairs of the radial projections 19 bounding said portions form the walls of a longitudinal passage 26 wherethrough the slurry handled can reach the clearances 13 between the discs 11 from the bore 4 of the scroll quill 3 through said slots 25. For feeding the slurry from the bore 4 of the quill 3 of the scroll 2 into the longitudinal passages 26, the bottom plate 14 of the stack of the separating discs 11 is provided with through holes 27.

Since the longitudinal passages 26 in the stack of the separating discs 11 are separated from the clearances 13 between the discs 11 and cannot communicate with same except through the slots 25, there is a practical possibility that the slurry centrifuged can be distributed between the clearances 13 separating the discs 11 uniformly over the entire height of the stack of the discs 11.

Figure 3:
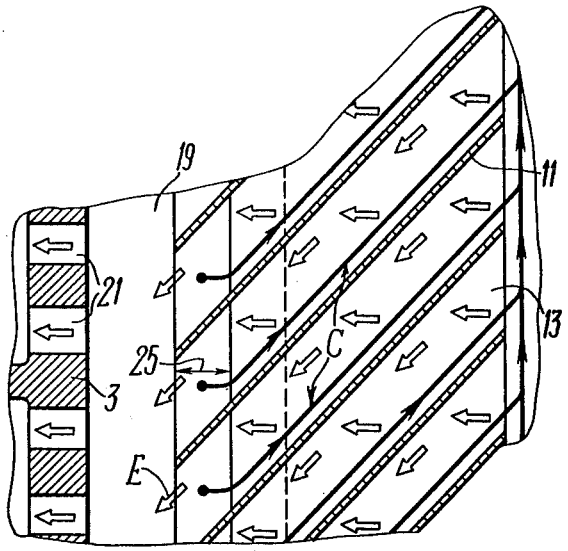
FIG. 3 is a view of area A in FIG. 1 on an enlarged scale.
Figure 4:
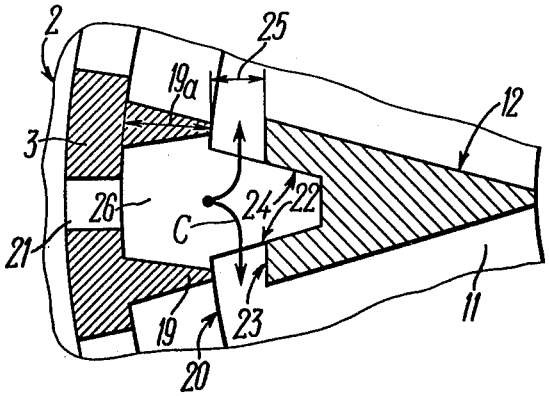
FIG. 4 is a view of area B in FIG. 2 on an enlarged scale.

Another point which is even more important than that explained above is that by virtue of said arrangement the flow C (FIG. 1) of the slurry does not meet the flow E of the cake. The flows of the slurry and the liquid clarified are shown in FIGS. 1, 3 and 4 by solid arrows C and the flow of the cake separated, by blank arrows E.

The bowl of centrifuge operates on the lines disclosed below.

When the bowl is set spinning at a high speed, the surface of the liquid contained therein is a paraboloid of revolution with a shallow curvature and for this reason the surface can be regarded as being a cylindrical one. As more slurry to be centrifuged is fed into the bowl case 1, the diameters of said surface diminishes, becoming finally equal to the diameter, D, of the annular threshold 10 of the case. Any further reduction of the diameter ceases at this stage because any amount of the slurry in excess of the bowl contents will pass through openings 28 in the cover plate 17, overflow the threshold 10 and discharge through the openings 8 of the bowl case 1 into a wet housing 29 (FIG. 1) surrounding said bowl case. So, a constant flow of the slurry centrifuged will be established, starting from the point where the slurry is being fed through the feed pipe 5 and ending at the points where the liquid clarified is discharged through the openings 8 in the bowl case 1. Said flow follows a pattern which is possible only if the bowl is designed in accordance with the invention.

The inflow of the slurry from the pipe 5 enters the bore 4 of the quill 3 of the scroll 2, passes through the openings 27 in the bottom plate 14 of the stack into the longitudinal distributing passages 26 of the stack of the separating discs 11 wherefrom it reaches in parallel flows C through the slots 25 the clearances 13 between the discs 11 and then enters a space 30 inside the stack. Thence, the liquid passes through the openings 28 in the stack cover plate 17, overflows the annular threshold 10 into the collecting chamber 9 of the bowl case 1 and leaves into the wet housing 29 through the openings 8.

The process of settling the particles of the solid matter contained in the slurry centrifuged goes on without interruption all along the path of the slurry on its way from the point of feeding through the pipe 5 to the space 30 inside the stack of the discs 11.

The coarser easily depositable particles settle from the flow C of the slurry directly in the zone of inflow, being then disposed of from the bore 4 of the quill 3 through the holes 21 in the wall of said quill into the space of the bowl case 1 close to its walls wherefrom the cake is conveyed by screw blades or paddles 31 of the scroll 2 to the openings 6 in the bowl case 1 for discharging into the dry housing 7.

Medium particles of the solid matter settle partly in the same zone as the coarser ones, partly on their way to the distributing passages 26 and partly in the passages 26 proper, being then discharged through the holes 21 pierced between the radial projections 19 into the bowl case 1 where the screw blade paddle 31 of the scroll conveys them downwards.

The bulk of fine particles of the solid fractions with the rest of medium particles which were unable to settle is fed from the longitudinal passages 26 into the stack of the discs 11 together with the liquid, reaching then the clearances between the separating discs 11 through the slots 25. In the clearances 13, which are of a small size, the length of the path travelled by the particles in settling is consequently short and, since the flow is a relatively slow and strictly a laminar one, the fine particles rapidly settle on the inner surface of the separating discs 11 and so do the rest of medium particles. As a result, overflowing the annular threshold 10 of the bowl case 1 and reaching the openings 8 therein is only clarified liquid.

The cake E building up on the inner surfaces of the discs 11 (see FIG. 3) is acted upon by the centrifugal forces which cause it to flow between the spacers 12 (FIG. 4) down the generatices of the discs 11, reaching thus the periphery thereof, wherefrom the cake passes into the bowl case 1 through the holes 21 in the wall of the quill 3 of the scroll 2.

Since the height 19*a* of the projections 19 exceeds half the maximum distance between the nearest edges of the adjacent holes 21 in the wall of the quill 3 of the scroll 2, the cake deposited does not block the clearances 13 between the discs 11 and does not interfere with the outflow of cake therefrom. The holes 21 in the wall of the quill 3 of the scroll 2 available between the pairs of the radial projections 19 all the way along the passages 26 prevent the blocking of same by the cake. A uniform inflow of the slurry centrifuged into the clearances 13 between the separating discs 11 all the way up the height of the stack is achievable by selecting the right ratio between the dimensions of the slots 25 and the longitudinal passages 26.

Since the inflow of the slurry reaches the clearances 13 only through the longitudinal passages 26 and the slots 25, the outflow of the cake towards the wall of the bowl case 1 is undisturbed, no turbidity takes place and no cake is carried back into the stack by the slurry inflow so that the bowl operates with maximum efficiency.

The fact that the stack of the discs 11 is aligned in the quill 3 of the scroll 2 from the outside makes for the washing of the clearances 13 between the discs 11 without taking the centrifuge apart so that the reliability of the centrifuge is enhanced and the operation simplified. At the same time, the bowl of the design disclosed allows to increase the throughput of the centrifuge and improve the process of slurry separation.

What is claimed is:

1. A bowl of a solids-concentration centrifuge comprising a hollow case having opposed ends and being formed at the region of one of said ends with outflow openings for clarified liquid and at the region of the other of said ends with discharge openings for the discharge of a cake, said case having a central axis, and a scroll situated coaxially within said case and including a quill and a screw extending outwardly from said quill to the region of an inner surface of said case, said quill having at the region of said discharge openings of said case an inlet for receiving a slurry which is centrifuged, and said quill having an interior hollow bore, a stack of separating discs situated in said hollow quill bore of said scroll at the region of said outflow openings of said case, said stack of separating discs each having the configuration of a truncated cone and each having inner and outer peripheral edges, spacers situated between said separating discs to maintain them spaced from each other so that said discs define between themselves clearances in which slurry is centrifuged, said discs being formed at the region of their outer peripheral edges with holes extending inwardly from the outer edges of said discs for placing all of the clearances between the discs in communication with each other so as to enable the slurry which is centrifuged to pass from said bore of said quill of said scroll into said clearances, said quill having an inner surface directed toward said stack of discs and provided with radial projections extending from said inner surface of said quill into engagement with said outer peripheral edges of said discs for positioning the latter coaxially within said quill of said scroll, and said quill of said scroll being formed with quill holes passing through said quill for placing a space defined between said quill and case in communication with the interior bore of said quill so as to allow the cake to discharge through said quill holes into said space between said quill and case, said quill holes being situated at the region of the interior bore of said quill which is occupied by said stack of separating discs and said quill holes also being situated between said radial projections of said quill.

2. A bowl as claimed in claim 1, wherein said radial projections of said quill are arranged in pairs equidistantly around the axis of said quill and said holes of said separating discs at said outer peripheral edges thereof being of a trapezoidal configuration and forming at each pair of radial projections a series of coaxial trapezoidal recesses all in radial alignment with a part of said inner surface of said quill situated between each pair of radial projections thereof, said spacers being respectively situated at said trapezoidal recesses and also being formed with recesses registering with said recesses of said discs, said spacers terminating in outer edges situated on both sides of said trapezoidal recesses and terminating short of said outer peripheral edges of said separating discs to define with inner edges of said radial projections slots through which the slurry to be centrifuged are admitted into the clearances between said discs.

3. A bowl as claimed in claim 1, wherein each of said radial projections is of a trapezoidal cross section and has an inner shorter base surface engaging the outer peripheral edges of said discs.

4. A bowl as claimed in claim 3, wherein said radial projections each have a radial dimension greater than one-half the maximum distance between edges of adjacent quill holes.

* * * * *